US006679274B2

(12) United States Patent
Gruszczynski et al.

(10) Patent No.: US 6,679,274 B2
(45) Date of Patent: Jan. 20, 2004

(54) CLEAN-IN-PLACE METHOD FOR CLEANING SOLUTION DELIVERY SYSTEMES/LINES

(75) Inventors: David W. Gruszczynski, Webster, NY (US); Douglas E. Margevich, Rochester, NY (US); Mark Fornalik, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 222 days.

(21) Appl. No.: 09/927,964

(22) Filed: Aug. 10, 2001

(65) Prior Publication Data

US 2003/0062066 A1 Apr. 3, 2003

(51) Int. Cl.[7] ..... B08B 9/00

(52) U.S. Cl. ..... 134/22.12; 134/22.1; 134/22.11; 134/22.13; 134/22.14; 134/22.16; 134/22.17; 134/22.18; 134/22.19; 134/26; 134/29; 134/34; 134/36; 134/42; 510/169

(58) Field of Search ..... 134/22.1, 22.11, 134/22.12, 22.13, 22.14, 22.16, 22.17, 22.18, 22.19, 26, 29, 34, 36, 42; 510/169

(56) References Cited

U.S. PATENT DOCUMENTS 5,605,633 A * 2/1997 Nakamura et al. ..... 210/732
5,941,257 A * 8/1999 Gruszczynski, II ..... 134/22.11
2003/0062066 A1 * 4/2003 Gruszczynski et al. .. 134/22.12

* cited by examiner

*Primary Examiner*—Sharidan Carrillo
(74) *Attorney, Agent, or Firm*—Mark G. Bocchetti

(57) ABSTRACT

A method is taught for cleaning photographic chemistry product fouling, including a proteinaceous portion and a non-proteinaceous portion from a liquid delivery system. The method comprises the steps of displacing resident product solution in the piping with water, hydrodynamically cleaning the piping system using two-phase flow a first time, chemically cleaning the piping system with an aqueous bleach solution to remove the proteinaceous portion of the photographic chemistry product fouling, chemically cleaning the piping system with a functionalized ethyl acetate solvent to remove the non-proteinaceous portion of the photographic chemistry product fouling, and hydrodynamically cleaning the piping system using two-phase flow a second time after the chemical cleaning steps to remove remaining residue. Preferably, after the second hydrodynamic two-phase flow cleaning step, the delivery system is subjected to a high purity water rinse.

5 Claims, 2 Drawing Sheets

CLEAN-IN-PLACE METHOD FOR CLEANING SOLUTION DELIVERY SYSTEMES/LINES

FIELD OF THE INVENTION

The present invention relates generally to methods for cleaning piping systems and equipment, and, more particularly, to methods for cleaning piping systems and equipment that supply or transport aqueous gelatin based solutions, such as those used in the manufacture of photosensitive media.

BACKGROUND OF THE INVENTION

The manufacture of photosensitive media utilizes liquid transfer systems, which are commonly called solution delivery systems for the delivery of various chemicals and emulsions. The solution delivery system consists of permanent (pumps, sensors, etc.) equipment and semi-permanent equipment (hoses, gaskets, etc.). Once a solution delivery system has completed delivering liquid formulations and/or solutions for a particular product, the system must be purged and cleaned in preparation for the manufacture of a subsequent and different product.

Many methods are used to clean the solution delivery system in preparation for the subsequent product. These methods include both off-line and in-situ methods. Off-line methods may include, but are not limited to, complete disassembly and hand cleaning, complete disassembly and parts washing (automated parts washer), complete disassembly and disposal of "some" system components, etc. In-situ methods may include, but are not limited to, "pig" cleaning, automated on-line cleaning, etc.

Off-line cleaning options (disassembly, etc.) typically require an extensive amount of time to complete. In these methods, there is also the potential for equipment to be re-assembled improperly which could lead to liquid waste and machine downtime.

Numerous chemical cleaning solutions exist for off-line cleaning of removed components. Depending on the number of parts and their size, the parts can be either hand cleaned (using scrub brushes, etc.) or cleaned in "parts washers." Parts washers are well known apparatus that clean parts via immersion, spray cleaning, and even ultrasonic methods to clean the parts. These cleaning enhancement methods can be employed with virtually any chemical cleaning solution.

On-line cleaning techniques have the advantages of: less machine downtime and less manpower to execute a cleaning operation of a solution delivery system.

In methods such as "pig" cleaning, there is still some operator intervention required and it is difficult to clean the entire delivery system because a "pig launcher" and "pig receiver" are required. In addition, "pig" cleaning may also utilize "ball" valves, which are not sanitary valves.

Clean-In-Place cleaning techniques can utilize a variety of different cleaning solutions and the method of introduction of those cleaning solutions can be automated to a variety of different levels. Clean-In-Place technologies have the advantage of being completely automated and can utilize sanitary valves such as those used in the pharmaceutical industry (e.g. diaphragm valves, balloon valves, etc.). The problem with Clean-In-Place technologies is that a series or sequence of cleaning solutions must be identified that can efficiently clean the fouling left by all product solutions that are delivered through the solution delivery system.

SUMMARY OF THE INVENTION

It is therefore an object of the present invention to provide a method for cleaning-in-place piping systems and equipment that supply or transport aqueous gelatin based solutions, such as those used in the manufacture of photosensitive media.

It is a further object of the present invention to provide a clean-in-place methodology that is capable of removing the fouling from aqueous, gelatin-based, sensitizing solutions.

Yet another object of the present invention is to provide a clean-in-place method that is capable of removing the numerous constituents in the adsorbed fouling as well as addressing the absorption fouling associated with polymeric materials in the solution delivery system.

Still another object of the present invention is to provide a clean-in-place method that is capable of cleaning photographic chemistry product fouling including a proteinaceous portion and a non-proteinaceous portion from the delivery system.

Briefly stated, the foregoing and numerous other features, objects and advantages of the present invention will become readily apparent upon a review of the detailed description, claims and drawings set forth herein. These features, objects and advantages are accomplished by practicing a method comprising the steps of displacing resident product solution in the piping with water, hydrodynamically cleaning the piping system using two-phase flow a first time, chemically cleaning the piping system with an aqueous bleach solution to remove the proteinaceous portion of the photographic chemistry product fouling, chemically cleaning the piping system with a functionalized ethyl acetate solvent to remove the non-proteinaceous portion of the photographic chemistry product fouling, and hydrodynamically cleaning the piping system using two-phase flow a second time after the chemical cleaning steps to remove remaining residue. Preferably, after the second hydrodynamic two-phase flow cleaning step, the delivery system is subjected to a high purity water rinse.

The first chemical cleaning step is performed with a dilute sodium hypochlorite solution. The second chemical cleaning step is performed with a functionalized ethyl acetate solvent. The water flushing and initial two-phase flow cleaning step remove water-soluble fouling through dilution and mass transfer. Chemical cleaning removes water insoluble fouling which is left by aqueous, gelatin-based, sensitizing solutions. The dilute sodium hypochlorite solution attacks the protein that is left by the product solution. The functionalized ethyl acetate solution is used to clean a variety of residuals, including: latex solutions, coupler solvents, etc. In addition, the functionalized ethyl acetate solution also removes absorption fouling that exists in polymeric solution delivery system materials (hoses, gaskets, etc.). The secondary two-phase flow cleaning is utilized to remove any residual fouling that the chemical cleaning solution loosened but did not remove. Finally, the high purity water flush is used to temper the solution delivery system to the appropriate coating temperature and put the highest quality water in the delivery system prior to inserting the next product solution.

DETAILED DESCRIPTION OF THE INVENTION

Figure 1:
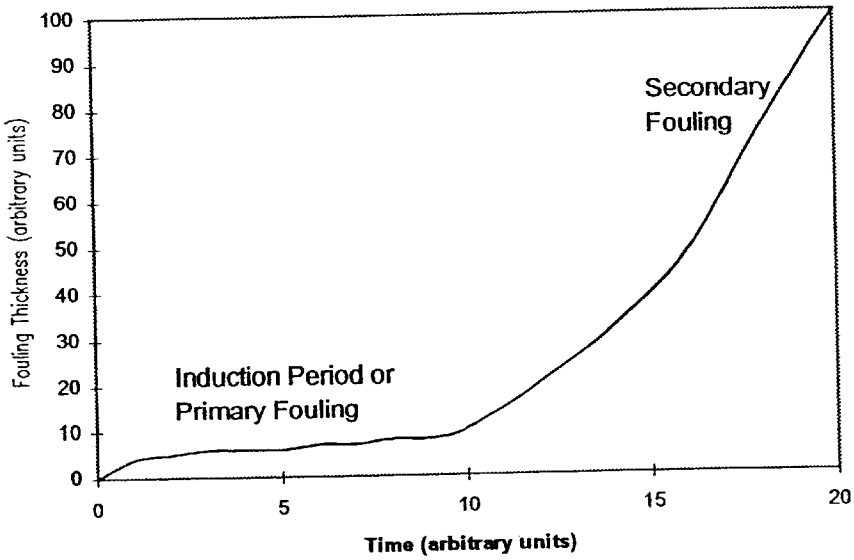
FIG. 1 is a graph plotting fouling deposition thickness (in arbitrary units) versus time (in arbitrary units).

The fouling found in the photographic industry can be categorized in terms of its composition: aqueous based fouling (gelatin, silver halide, etc.), non-aqueous based (latex components, coupler solvents), biological fouling, or combination fouling (a combination of the three other fouling types). This distinction or categorization was made in the fouling composition to align fouling with respective cleaners, i.e., not one chemical cleaner is effective on all fouling.

Investigation has shown that fouling from aqueous, gelatin based, photographic solutions develops in two stages, primary and secondary fouling, and is a combination of chemical fouling (chemical reaction or particulate fouling), corrosion fouling and biological fouling.

Primary fouling, as the name implies, refers to the initial fouling deposited on the surface. The composition of primary or induction fouling of aqueous melts at Eastman Kodak Company has been identified as native and denatured proteins. The fouling is very thin, on the order of 100 Angstroms thick.

The kinetics of primary fouling are extremely fast, with protein layer adsorption (physical adhesion to the surface) taking place in minutes. Primary fouling is difficult to remove because the layer is so thin (well within the laminar boundary layer of turbulent flow). In addition, it is believed that primary fouling possesses high adhesion strength. The mechanism for the deposit of the primary fouling layers is unknown.

Secondary fouling, as the name implies, refers to the fouling that is deposited sequentially after primary fouling. The composition of the secondary fouling is different for each solution, but typically is comprised of silver halide, dyes, and color couplers. Physically, the fouling can be orders of magnitude thicker than primary fouling, on the order of 100 to 10,000 Angstroms.

Secondary fouling kinetics are different for each product solution, typically occurring within tens of minutes of exposure. Removal of secondary fouling is generally easier than primary fouling. The ease in removal is due to the entrapment of the fouling in a thick gelatin fouling matrix. The increased layer thickness facilitates or enables hydrodynamic cleaning. In addition, the secondary fouling is believed to be more porous, thus, the chemical cleaners can be more effective.

Biological fouling, considered secondary fouling, involves the adsorption of biological organisms and their glyco-protein onto the surfaces of the solution and/or liquid delivery system (SDS). Planktonic or free-floating bacteria adhere to the surfaces because the delivery systems are relatively low shear environments with an ample supply of nutrients (stainless steel [biological organisms can digest stainless steel—bio-induced corrosion], product solutions, etc.). The bacteria adhere to the surface and begin to form colonies which include the formation of glyco-protein tendrils that the organism uses to attach itself to the surface and increase its surface area (to collect more nutrients). The kinetics of biofouling is dependent on the solution; typically biofouling can occur on the order of hours or days.

Studies conducted by Montana State University "Center for Biofilm Engineering" indicate that between 90 and 99% of all biological organisms are adhered to the walls of the process piping, or sessile, while the remainders of the biological organisms are planktonic or free floating. Both sessile and planktonic bacteria can produce byproducts that are sensitometrically active (nitrite, bio-surfactant, etc.), thus resulting in sensitometric shifts or sensitometric non-conformance. In addition, biological fouling can result in physical defects (spots and streaks), which arise when large bacteria colonies are dislodged from the surfaces of the SDS.

Non-aqueous fouling in the manufacture of photosensitive media arises from solutions that have "unique" solution addenda (non-gelatin based, e.g.—silver halide, color couplers, dyes, latexes). The kinetics and composition of the fouling is dependent on the product solution. Typical non-aqueous fouling solutions include latex components, hardeners, coupler solvents (for flexible hoses), and specialty components (proprietary). Typically, alternative chemical cleaners are required to address the fouling from these products.

Understanding of fouling kinetics, fouling composition, fouling adhesion strength, and the impact of primary and secondary fouling on product conformance is necessary to optimize cleaning procedures. System cleaning must be able to remove/reduce fouling such that products can be made with 100% physical or sensitometric conformance (with respect to SDS fouling related contaminants).

To demonstrate the level of fouling to be cleaned, a simulated fouling deposition versus time graph is depicted in FIG. 1. The initial portion of the curve in FIG. 1 simulates the deposition for the primary (induction period) fouling, while the upper portion of the curve simulates the secondary fouling deposition. The removal of primary fouling is very difficult, requiring excessive time, special chemical, or special mechanical techniques. Based on the removal and impact of fouling information, a specification of the cleaning system effectiveness can be established: the cleaning system is required to remove secondary fouling (i.e., return the surface to the primary or induction region of the fouling curve).

Figure 2:
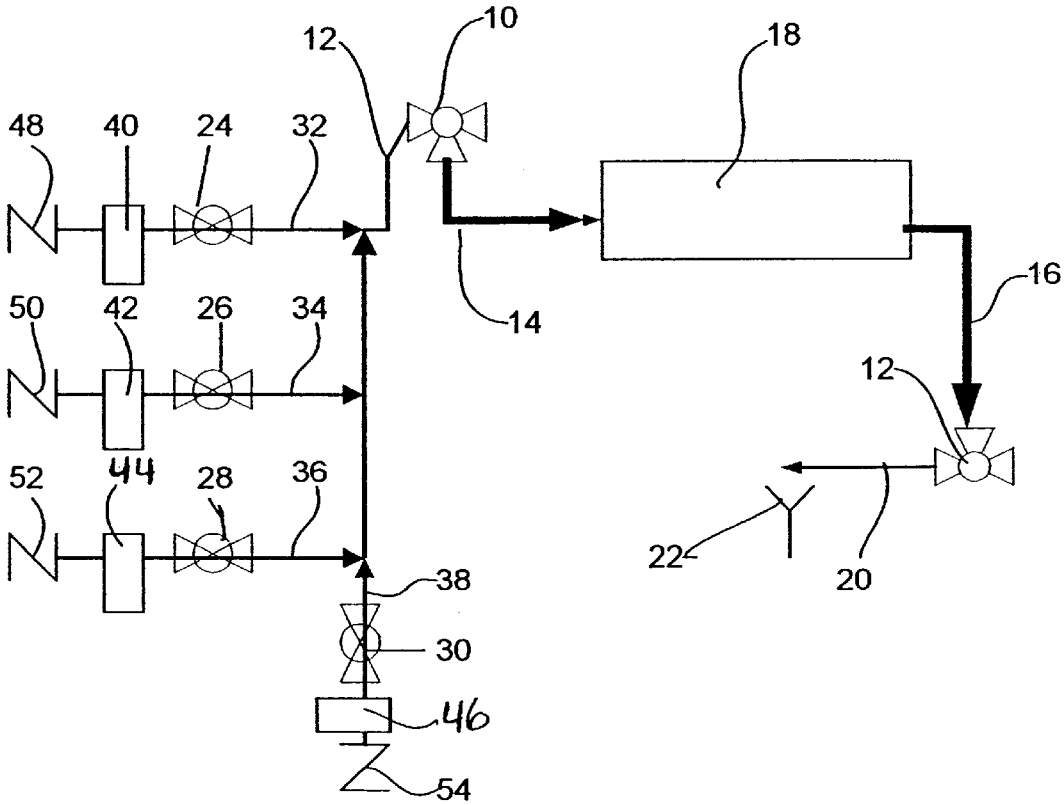
FIG. 2 is a schematic piping diagram showing an exemplary pipe and valve arrangement that can be used in the practice of the method of the present invention.

The cleaning sequence of the present invention may be applied, in practice, to an existing liquid distribution system through any number of process configurations. FIG. 2 schematically depicts one such possible configuration. Process valves 10, 12 define the beginning and the end of the process to be cleaned by the method of the present invention. The apparatus/system to be cleaned includes an inlet line(s) 14, an outlet line(s) 16 and may also include various delivery system apparatus 18 such as pumps, filters, valves, sensors, etc. The cleaning solutions are injected into the apparatus/system through valve 10 and exits the apparatus/system through valve 12. Upon leaving valve 12, the solution exits through line 20 to drain 22.

The selection and delivery of cleaning solutions is controlled through the actuation of valves 24, 26, 28, and 30 located in supply conduits 32, 34, 36 and 38, respectively. These valves 24, 26, 28, and 30 can be actuated individually or, in the case of two-phase flow cleaning, valves 24, 30 can be opened simultaneously. The flow of the cleaning liquids and air is controlled through operation of the flow regulators 40, 42, 44, 46 controlling actuation of valves 24, 26, 28, and 30, respectively. In addition, to prevent back-flow of one cleaning liquid into a different supply conduit (if a valve 24, 26, 28, 30 fails), a check valve 48, 50, 52, 54 are added to each cleaning solution supply conduit.

As mentioned above, the first method of the present invention is to use water to displace any product solution remaining in the apparatus/system to be cleaned. Solution displacement involves the initial flushing of the resident solution from the SDS. This step in the cleaning process removes the bulk of the resident solution from the process piping and begins the process of dissolving the adhered or hardened water-soluble fouling. Insufficient solution displacement can lead to localized regions of residual product solution, which make hydrodynamic and chemical cleaning less efficient.

Water flush duration for solution displacement is typically examined in terms of the number of Cleaning Volume Turnovers (CVT's). A CVT is the amount of solution flow required to fill the delivery system one time:

$$\left(CVT = \frac{CleaningFlowRate}{SystemVolume} \times CleaningTime;\quad CVT \text{ is a dimensionless parameter}\right).$$

Due to non-plug flow conditions, one volume turnover does not completely displace the resident solution. Laboratory studies were conducted to determine the CVT's required for solution displacement. The results of those studies are outlined in Table 1 below.

TABLE 1

Minimum Recommended Cleaning Volume Turnovers for Solution Displacement - Based on SDS Component Size and Resident Solution Viscosity

| Hose Diameter | Gelatin: 1 cP–10 cP | Gelatin: 10 cP to 50 cP | Gelatin: >50 cP | Dilute sodium hypochlorite solution # of volume turnovers |
|---|---|---|---|---|
| ⅜" ID Hose: Flow Range: 5 to 20 kgs/min Flow Velocity: 1.2 to 4.7 m/s Reynolds No.: 11139 to 44554 | 2.0 | 2.5 | 4.0 | 3.0 |
| ⅝" ID Hose Flow Range: 5 to 30 kgs/min Flow Velocity: 0.4 to 2.5 m/s Reynolds No.: 6683 to 40099 | 2.0 | 2.0 | 3.0 | 3.0 |
| 1" ID Hose Flow Range: 5 to 40 kgs/min Flow Velocity: 0.2 to 1.3 m/s Reynolds No.: 4177 to 33416 | 2.0 | 2.0 | 3.0 | 3.0 |

The results shown in Table 1 indicate that solution displacement is dependent on the resident solution viscosity, the flow rate of the water, and the configuration of the system. The effect of these parameters on the number of CVT's required for solution displacement indicates that (1) increased resident solution viscosity results in an increased number of CVT's for resident solution removal; (2) an optimum water flow rate exists to minimize the number of CVT's required and that flow rates higher than the optimum flow rate will result in lower water flush time, but a larger number of CVT's are required; (3) increased system volume results in an increased number of CVT's for resident solution removal. The hose diameter information provided in Table 1 above refers to the inside diameter of the piping being cleaned in the examples set forth in Table 1.

It is preferred that the average water flow velocity during the solution displacement phase be between 5 and 7 linear ft/sec. Flow rates meeting these criteria minimize the time required to complete the solution displacement step (solution displacement is based on CVT's) while imparting a higher wall shear stress to assist in the removal of residual solution.

After solution displacement, the system is hydrodynamically cleaned using two-phase flow. The method for generating two-phase flow cleaning is described in U.S. Pat. No. 5,941,257 to Gruszczynski II entitled "Improved Method for Two-Phase Flow Hydrodynamic Cleaning".

The increased hydrodynamic cleaning effect of two-phase flow hydrodynamic cleaning removes water-soluble and loosely adhered water insoluble materials that were not removed by the water flush cleaning technique. This technique is used in preparation for the chemical cleaning techniques. Through the minimization of residual fouling, two-phase flow hydrodynamic cleaning enables more effective chemical cleaning.

Power-flush or two-phase flow cleaning involves the simultaneous delivery of both air and water through the SDS. The ratio of the air and water determines the cleanability properties of the flow. The proper mixture of air and water and optimized power-flush flow, generates air and water slugs (sometimes referred to in the art as "slug" flow). The power-flush water slugs are turbulent or chaotic and have a larger average velocity than water flow alone. Thus, power-flush flow produces higher wall shear stresses (higher than water flow alone), resulting in a more effective cleaning flow.

When conducting the power-flush or two-phase flow cleaning step, it is preferred that the guidelines taught in U.S. Pat. No. 5,941,257 are followed to establish the optimum flow rate ratio for power-flush cleaning. The highest possible water and airflow rates should be used (with the intent of increasing cleaning capability by attaining the highest wall shear stress). As long as the water and airflow rates are maintained, per the guidelines taught in U.S. Pat. No. 5,941,257, the internal diameter of the pipe does not impact the performance of the two-phase flow. The maximum recommended hose length (length of the flow path through the SDS) for a continuous power-flush is 100 feet (although longer lengths can be effectively cleaned if the water and airflow rates are maintained).

The gas and liquid phases of two-phase flow can separate in large volume devices. The phase separation can result in insufficient cleaning of the device and in cases where the mass balance is not maintained (i.e., gas is able to escape) the two-phase flow cleaning on the process piping exiting the device can be compromised. Therefore, in devices where the two-phase flow mass balance is altered, the device can either be by-passed or cleaned independently of the rest of the system (off-line cleaning, sequential use of a single two-phase flow supply, or simultaneous use of an alternate two-phase flow supply).

Figure 3:
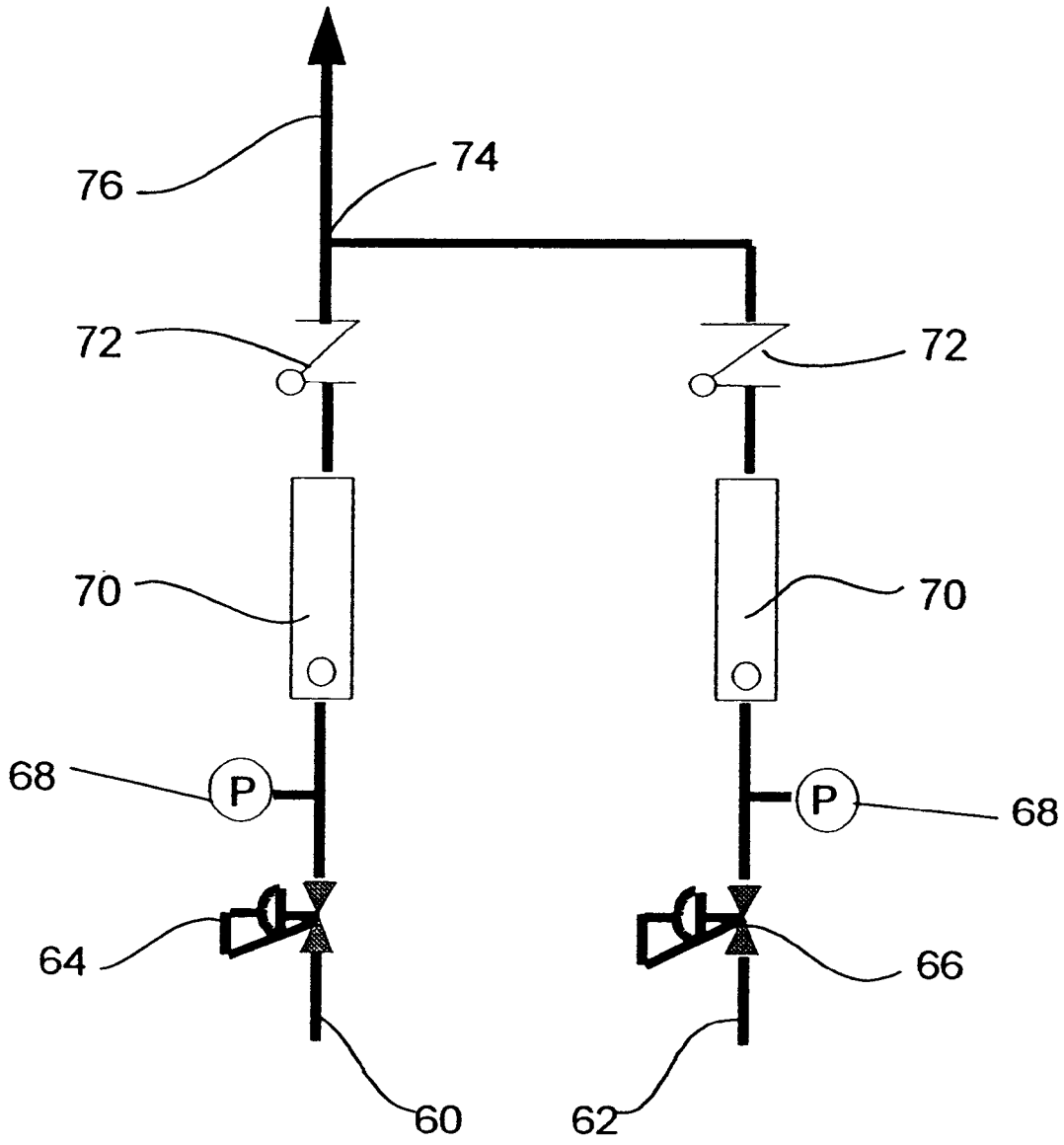
FIG. 3 is a schematic diagram of one example of a two-phase flow cleaning apparatus that can be used in the practice of the present invention.

Power-flush, two-phase flow cleaning, requires the simultaneous delivery of gas (air) and liquid (water) phases. The equipment required to generate power-flush flow is relatively simple and low cost. A schematic representation of one example of the equipment necessary to generate power-flush flow is shown in FIG. 3. There is a first conduit 60 through which the incoming cleaning liquid (e.g., water) is transmitted to the apparatus/system being cleaned. There is a second conduit 62 through which the gas (e.g., air) is transmitted to the apparatus/system to be cleaned. There is a pressure regulator valve 64 in conduit 60 and a pressure regulator valve 66 in conduit 62. In addition, each conduit 60, 62 has a pressure gauge 68 mounted thereon. Downstream of each pressure gauge 68 is a flow measurement and flow regulation device 70. Each flow measurement and flow regulation device 70 is preferably a positive displacement type of device, such as a rotometer. Downstream of each flow measurement and flow regulation device 70 and mounted in the respective conduit 60, 62 is a check valve 72. The conduits 60, 62 then merge at a mixing tee 74 with a resulting combined pipeline 76 being connected to the apparatus/system to be cleaned (not shown). With this two-phase flow cleaning system attached to the apparatus/system to be cleaned, the liquid flow is turned on first. Once the system to be cleaned is filled, the gas flow is then begun. Pressure gauges 68 are used to determine the system pressure.

The optimization equation taught in U.S. Pat. No. 5,941,257 is then applied to determine the optical flow rate ratio. The flow measurement and flow regulation device 70 is then used to adjust the desired optimum flow rate for each stream.

A comparison study was performed to determine the effect on cleaning time when using a power-flush (two-phase flow) versus not using a power-flush. The experimental results are tabulated in terms of the time required to successfully clean the delivery system to a specified level of cleanliness (99% removal). These results are summarized in Table 2.

TABLE 2

Hydrodynamic Cleaning Conditions Required to Achieve 99.0% Removal of Fouling

| | Required Cleaning Times (seconds) | | | |
|---|---|---|---|---|
| | Temperature <47.5° C. | | Temperature ≧47.5° C. | |
| Powerflush Conditions | Flow <12.5 1/min | Flow ≧12.5 1/min | Flow <12.5 1/min | Flow ≧12.5 1/min |
| No Powerflush | Flush = 290 Powerflush = 0 | Flush = 145 Powerflush = 0 | Flush = 270 Powerflush = 0 | Flush = 130 Powerflush = 0 |
| With Powerflush | Flush = 0 Powerflush = 115 | Flush = 0 Powerflush = 110 | Flush = 0 Powerflush = 95 | Flush = 0 Powerflush = 80 |

The data presented in Table 2 indicates that the use of power-flushing can dramatically reduce the required cleaning time. This is especially true for sites that have limited water flow capabilities and/or low water temperature. Table 2 also shows the significance of water flow rate in cleaning time. This can be explained by the major (order of magnitude) differences in wall shear stress between water only flush and a two-phase flow flush.

The chemical cleaning steps of the present invention are designed to remove process fouling that is water insoluble. As such it is preferable to remove all or substantially all (at least about 95%) of the water soluble fouling with the two-phase flow water flushing techniques prior to chemical cleaning. The chemical cleaners work by diffusion and chemical reaction to loosen, dissolve, or remove the fouling.

Two chemical cleaners are used in the practice of the method of preferred embodiment of the present invention. They are dilute sodium hypochorite solution and a functionalized ethyl acetate solvent. The sodium hypochlorite solution-contains a small amount of surfactant. The composition of the dilute sodium hypochlorite solution is: 0.25% NaOCl, 0.05% Neodol (25-7)® (surfactant) as sold by Shell Chemicals. The surfactant chosen was a non-ionic, low-foaming surfactant, which is the preferred surfactant for hard-surface cleaning of internal piping systems. This preferred surfactant is an alcohol-ethylolate based material; however, any non-ionic, low-foaming surfactant will suffice (such as, for example, Antarox L-64 as sold by Rhone-Poulenc). The solvent should be an ethoxy functionalized ethyl acetate solvent. The solvent used for the examples provided herein was 2-(2-ethoxyethoxy)ethyl acetate. This solvent was chosen based upon its hydrophobic/hydrophilic properties as an appropriate material for solvating both aqueous and non-aqueous materials. By altering the length of the aliphatic chain, the oil/water phase solvating properties can be controlled to address specific cleaning protocol.

The dilute sodium hypochlorite cleaning solution is used to clean protein based fouling, biological fouling, and the materials trapped in the protein/biological fouling (e.g., gelatin, silver halide, color couplers, biological organisms and their glycoprotein "glue" layer). The functionalized ethyl acetate solvent is used to clean the fouling from latex components, the absorption fouling of polymeric materials in the liquid transfer system, and other non-protein based fouling sources.

In the practice of the method of the present invention, it has been found that using the dilute sodium hypochlorite solution at an elevated temperature, approximately 120° F., provides optimum efficiency while also meeting safety restrictions and not violating equipment corrosion limits. In addition, using the dilute sodium hypochlorite solution at a concentration of 0.75% provides optimum efficiency.

Analysis of the effect of dilute bleach cleaning on biological fouling has indicated that the dilute sodium hypochlorite solution, at a pH of approximately 10.5, works to dissolve the glyco-protein structure produced by the biological organisms. This makes it possible to rinse the biofouling from the system. Laboratory biofouling tests, using Teflon® substrates, have indicated that biofouling can be dramatically reduced (~75% to 95% removal) through exposure to the dilute sodium hypochlorite solution for 10 minutes. Tests evaluating the frequency at which the dilute sodium hypochlorite solution cleaning is required to mitigate biofouling formation have also been performed. The results from these tests indicate that the above recommended the dilute sodium hypochlorite solution cleaning procedure is sufficient for the mitigation of biological fouling.

The dilute sodium hypochlorite solution and functionalized ethyl acetate solvent cleaning times have both been determined by empirical analysis. In both cases, increased time of exposure enables the chemicals to react more completely with the surface adhered fouling increasing the efficiency of the cleaning treatment.

Laboratory studies of dilute sodium hypochlorite solution cleaning efficiency examined the impact of exposure time, temperature, flow rate, and the efficiency of the hydrodynamic clean (prior to the chemical clean). The experimental results are shown in Table 3. Table 3 displays the chemical cleaning time required to achieve 99.5% removal of the fouling versus the temperature of the dilute sodium hypochlorite solution and the efficiency of the hydrodynamic clean. Table 3 shows the importance of an efficient hydrodynamic clean and increased dilute sodium hypochlorite solution temperature.

TABLE 3

Chemical Cleaning Conditions Required to Achieve 99.5% Removal of Fouling

| Level of Hydrodynamic Cleaning Efficiency, i.e., Chemical Cleaning Start Point | Temperature: <32° C. | Temperature: 32° C. < T < 43° C. | Temperature: >43° C. |
|---|---|---|---|
| 0% | 280 seconds | 200 seconds | 160 seconds |
| 50% | 200 seconds | 160 seconds | 120 seconds |
| 90% | 140 seconds | 120 seconds | 100 seconds |

Guidelines for the SDS cleaning sequence integration in the practice of the method of the present invention are outlined in Table 4. The data in Table 4 includes "safety factors." These safety factors were applied to the "raw" experimental data to make the cleaning procedure more robust and to account for production issues that may have been impossible to duplicate in the laboratory experiments.

TABLE 4

Optimized SDS Aqueous Gelatin-Based Cleaning Procedure

| Cleaning Operation | Water Flush Only Cleaning Sequence | Water Flush and Powerflush Cleaning Sequence | Operational Conditions |
|---|---|---|---|
| Solution Displacement | 3–6 Volume Turnovers Safety Factor: 1.5 | 3–6 Volume Turnovers Safety Factor: 1.5 | Volume Turnovers = f($\mu$, geometry). (See Table 1) Reynolds Number >4000; Turbulent Flow Length of Hose: 3 to 260 m |
| Hydrodynamic Clean - Powerflush | N/A | 160–230 seconds Safety Factor: 2.0 | Two-Phase Flow of Water and Air Time = f(T) (See Table 2) Two-Phase flow rate ratio and minimum water two-phase flow rate used. |
| Chemical Clean - Dilute Sodium Hypochlorite Solution | 200–560 seconds Safety Factor: 2.0 | 200–560 seconds Safety Factor: 2.0 | Time = f(initial cleanliness, T) (See Table 3) Flow - "Pulsed-flow" |
| Chemical Clean - Functionalized Ethyl Acetate | 5 minutes | 5 minutes | Flow - "Pulsed-flow" 80° F. 5 minutes |
| Line Fill | 2–3.5 Volume Turnover Safety Factor: 1.0 | 2–3.5 Volume Turnover Safety Factor: 1.0 | See Solution Displacement Operations Conditions above. |
| Secondary Hydrodynamic Clean - Powerflush | N/A | 35 seconds Safety Factor: 1.0 | See above "Hydrodynamic Clean - Powerflush" Description |
| Total Sequence Cleaning Time Without Functionalized Ethyl Acetate - MINIMUM TIME | 8 minutes 30 seconds Plus: Dilute Sodium Hypochlorite Solution Fill 5–9.5 Volume Turnovers | 6 minutes 35 seconds Plus: Dilute Sodium Hypochlorite Solution Fill Powerflush Fill 5–9.5 Volume Turnovers | Assumes solution displacement, minimum flush times, minimum chemical cleaning times and no need for Functionalized Ethyl Acetate cleaning. |

Utilization of the preferred embodiments of this cleaning method result in the management of residual fouling to a thickness on the order of 100 to 200 angstroms, or on the order of 2 to 5 $\mu g/cm^2$.

In addition, by utilizing the preferred embodiments of this cleaning method, a liquid transfer system can be cleaned in less than 10 minutes (depending on the volume of the system and the utility capabilities—see Tables 1, 2, and 3).

From the foregoing it will be seen that this invention is one well adapted to attain all of the ends and objects hereinabove set forth together with other advantages which are apparent and which are inherent to the process.

It will be understood that certain features and subcombinations are of utility and may be employed with reference to other features and subcombinations. This is contemplated by and is within the scope of the claims.

As many possible embodiments may be made of the invention without departing from the scope thereof. It is to be understood that all matter herein set forth and shown in the accompanying drawings is to be interpreted as illustrative and not in a limiting sense.

Parts List

10 Process Valve
12 Process Valve
14 Inlet Line
16 Outlet Line
18 Delivery System Apparatus
20 Line
22 Drain
24 Valve
26 Valve
28 Valve
30 Valve
32 Supply Conduit
34 Supply Conduit
36 Supply Conduit
38 Supply Conduit
40 Flow Regulator
42 Flow Regulator
44 Flow Regulator
46 Flow Regulator
48 Check Valve
50 Check Valve
52 Check Valve
54 Check Valve
60 Conduit
62 Conduit
64 Pressure Regulator Valve
66 Pressure Regulator Valve
68 Pressure Gauge
70 Flow Measurement and Flow Regulation Device
72 Check Valve
74 Mixing Tee
76 Pipeline

What is claimed is:

1. A method for cleaning photographic chemistry product fouling including a proteinaceous portion and a non-proteinaceous portion from a piping system comprising the steps of:

(a) flushing the piping system with water;

(b) cleaning the piping system using a two-phase flow of a liquid and gas for a first time;

(c) chemically cleaning the piping system with an aqueous bleach solution to remove the proteinaceous portion of the photographic chemistry product fouling;

(d) chemically cleaning the piping system wit a functionalized ethyl acetate solvent to remove the non-proteinaceous portion of the photographic chemistry product fouling; and (e) cleaning the piping system using the two-phase flow of the hg aid and gas for a second time after the chemical cleaning steps to remove remaining residue from the piping system.

2. A method as recited in claim 1 wherein the liquid and gas of the two-phase flow is air and water.

3. A method as recited in claim 1 wherein:

the functionalized ethyl acetate solvent is an ethoxy functionalized ethyl acetate solvent.

4. A method as recited in claim 1 wherein:

the aqueous bleach solution is an aqueous sodium hypochiorite solution.

5. The method as recited in claim 1, further comprising the step of, after step (e), flushing the piping system with water.

* * * * *

UNITED STATES PATENT AND TRADEMARK OFFICE

CERTIFICATE OF CORRECTION

PATENT NO. : 6,679,274 B2
DATED : January 20, 2004
INVENTOR(S) : David W. Gruszczynski, et al It is certified that error appears in the above-identified patent and that said Letters Patent is hereby corrected as shown below:

Column 11,
Line 6, after "the" delete " hg aid" and insert -- liquid --

Signed and Sealed this

Thirty-first Day of August, 2004

JON W. DUDAS
*Director of the United States Patent and Trademark Office*